US005477964A

United States Patent [19]

Hart

[11] Patent Number: 5,477,964

[45] Date of Patent: Dec. 26, 1995

[54] PACKAGE FOR AN ELONGATED TOOL

[75] Inventor: Richard H. Hart, Kensington, Conn.

[73] Assignee: The Stanley Works, New Britain, Conn.

[21] Appl. No.: 364,256

[22] Filed: Dec. 27, 1994

[51] Int. Cl.[6] ..... A45C 11/26; B65D 73/00; B65B 11/00

[52] U.S. Cl. ..... 206/349; 206/476; 206/482; 206/483; 206/485; 53/397

[58] Field of Search ..... 206/349, 476, 206/477, 481, 482, 483, 485, 490; 53/397; 211/70.6

[56] References Cited

U.S. PATENT DOCUMENTS

| | | | |
|---|---|---|---|
| 1,670,204 | 5/1928 | Moore | 206/482 X |
| 1,779,146 | 10/1930 | Reckford | 206/476 |
| 2,024,984 | 12/1935 | Bradley | 206/476 X |
| 2,833,419 | 5/1958 | Trumpy | 211/70.6 |
| 4,586,615 | 5/1986 | Quitmann | 211/70.6 |

FOREIGN PATENT DOCUMENTS

| | | | |
|---|---|---|---|
| 1385231 | 11/1964 | France | 206/476 |
| 1511935 | 11/1969 | Germany | 206/349 |
| 4207204 | 9/1993 | Germany | 206/349 |
| 308060 | 1/1969 | Sweden | 206/476 |
| 460459 | 1/1937 | United Kingdom | 206/476 |
| 2269577 | 2/1994 | United Kingdom | 206/476 |

*Primary Examiner*—Bryon P. Gehman
*Attorney, Agent, or Firm*—Pepe & Hazard

[57] ABSTRACT

A display package comprising a flexible card upon which is mounted an elongated tool with a handle and a shank at one end. The handle has a shoulder adjacent the shank, and a portion of reduced cross section between the shoulder and its other end, and it increases in cross section from the portion of reduced cross section towards the other end. The card has a generally planar body portion, and a flexible portion adjacent one end of the card extends at an angle to the body portion and has an aperture in which is seated the reduced portion of the handle. A slit extends radially outwardly from this aperture to enable flexure of the flexible portion to permit insertion of the handle into the aperture and to preclude withdrawal of the inserted handle. The card also has a tab intermediate the length of the body portion extending at an angle to the plane of the body portion, and having an aperture aligned with the aperture in the flexible portion, through which the shank extends.

12 Claims, 2 Drawing Sheets

FIG. 4
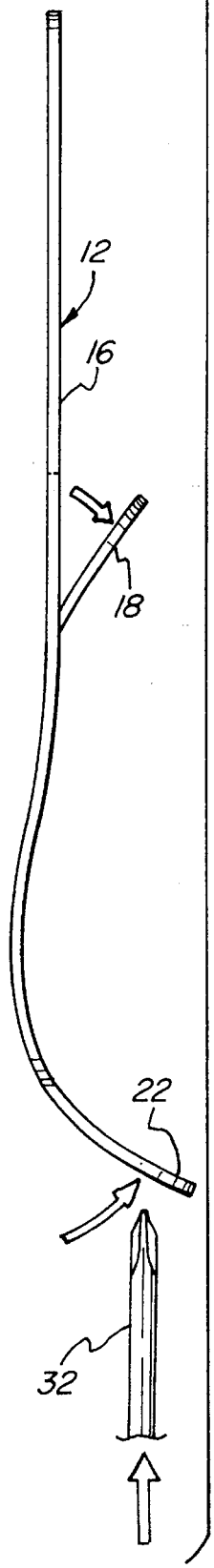
FIG. 5
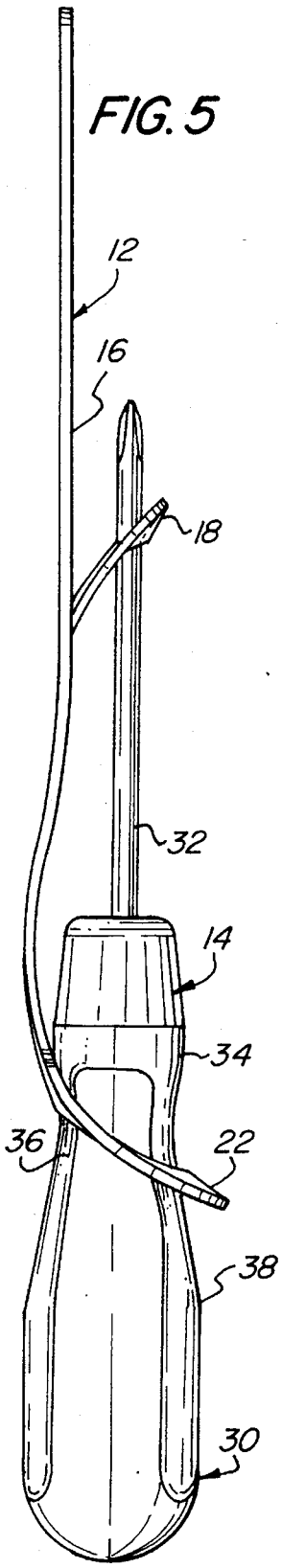
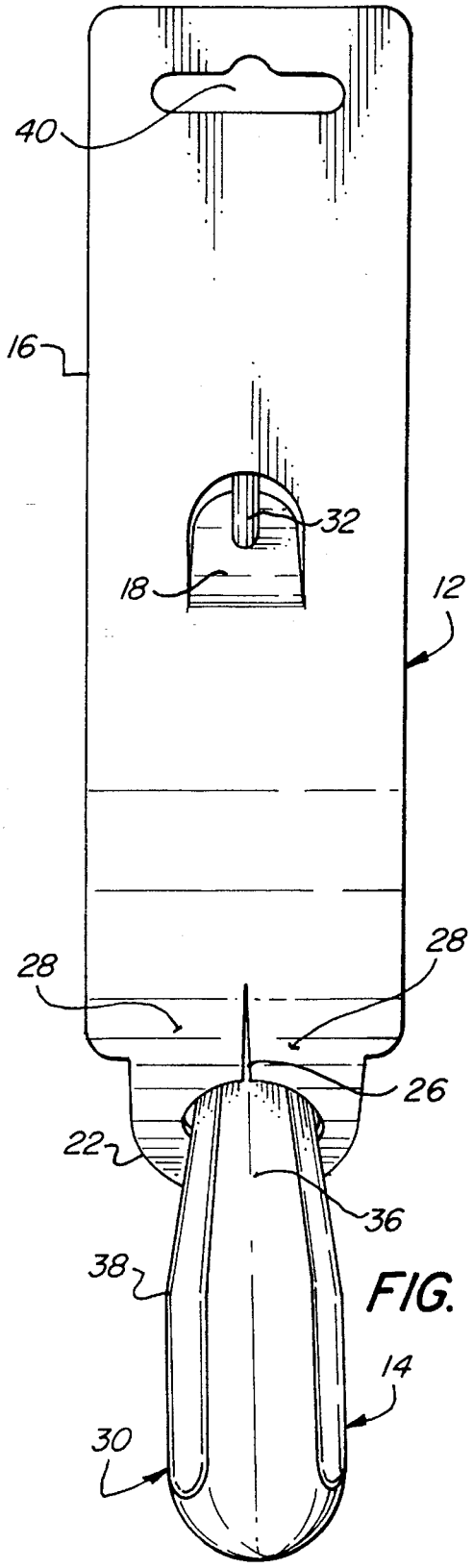
FIG. 6

PACKAGE FOR AN ELONGATED TOOL

BACKGROUND OF THE INVENTION

The present invention relates to merchandise display packages, and more particularly, to merchandise display cards for tools having handles and shanks.

Display cards are widely employed to mount articles for point of purchase displays. In such carded merchandise, the article of merchandise is commonly secured to the card by skin packaging, blisters and fasteners such as conventional wire staples or plastic ties.

Some display cards utilize tabs which may be bent upwardly from the plane of the body of the card and having apertures to receive and secure the merchandise to the card. Exemplary of such a card is Obeck U.S. Pat. No. 2,944,665. This card utilizes an elongated inverted V-shaped tab which is bent upwardly from the plane of the card and provided with ovoid-shaped apertures in both of its legs to receive the handle of a paint brush. The ovoid shaped apertures of the tab may be doubled together to bring them into register and allow the handle of a paint brush having a generally ovoid shape to be inserted therein. Once inserted, the brush is rotated a quarter turn about its longitudinal axis to a plane parallel to the card, and the brush handle is locked in the apertures as a result of their ovoid shape. The Obeck display card, however, does not afford a secure locking engagement for handles with a uniform cross section such as round handles.

It is an object of the present invention to provide a novel merchandise display package including an article with a handle and an elongated shank which is locked firmly to the card.

It is also an object to provide such a display package in which both the handle and the shank of the article are substantially fully exposed to enable handling and examination of the article by a consumer.

Another object is to provide such a package which does not require any additional fastening elements to secure the article to it.

A further object is to provide such a package which utilizes a display card which may be fabricated relatively easily and economically.

A still further object is to provide a novel method for securing a tool to a display card.

SUMMARY OF THE INVENTION

It has now been found that the foregoing and related objects may be readily attained in a display package comprising an elongated tool mounted upon a flexible card. The elongated tool has a handle with a shank extending from one end thereof. The handle, in turn, has a shoulder adjacent the one end, and a portion of reduced cross section between the shoulder and its other end, and it increases in cross section from the portion of reduced cross section towards the other end.

The flexible card mounting the elongated article has a generally planar body portion and a flexible portion adjacent one end which extends at an angle to the body portion and has an aperture in which is seated the reduced portion of the handle. A slit extends radially outwardly from the aperture in the flexible portion to enable flexure of the flexible portion to permit insertion of the handle into the aperture and to preclude withdrawal of the inserted handle. The card also has a flexible tab intermediate the length of the body portion extending at an angle to the plane of the body portion and having an aperture aligned with the aperture in the flexible portion, through which the shank extends.

Generally, the flexible portion is the end portion of the card at the one end, and it has an arcuate section adjacent the body portion in which the slit extends. The tab preferably extends in a direction away from the flexible portion.

In assembling a display package, a flexible card is formed with (i) a generally planar body portion, (ii) a flexible portion adjacent one end with an aperture therein and a slit extending radially outwardly from the aperture, and (iii) a flexible tab intermediate the length of the body portion with an aperture therein. The flexible portion and tab are bent into positions extending at an angle to the plane of the body portion of the card. A shank of a tool is then inserted through the aperture of the flexible portion and thence into the aperture of the tab.

Finally, the flexible portion about the slit is flexed to insert the handle of the tool into the aperture and seat the reduced portion of the handle in the aperture of the flexible portion.

BRIEF DESCRIPTION OF THE DRAWINGS

FIG. 4 is a fragmentary side elevational view of the display card with the tab and end portions bent upwardly as the shank of a fragmentary illustrated screwdriver is positioned for insertion thereinto;

FIG. 5 is a side elevational view of the package; and

FIG. 6 is a bottom view of the package.

DETAILED DESCRIPTION OF THE PREFERRED EMBODIMENT

Figure 1:
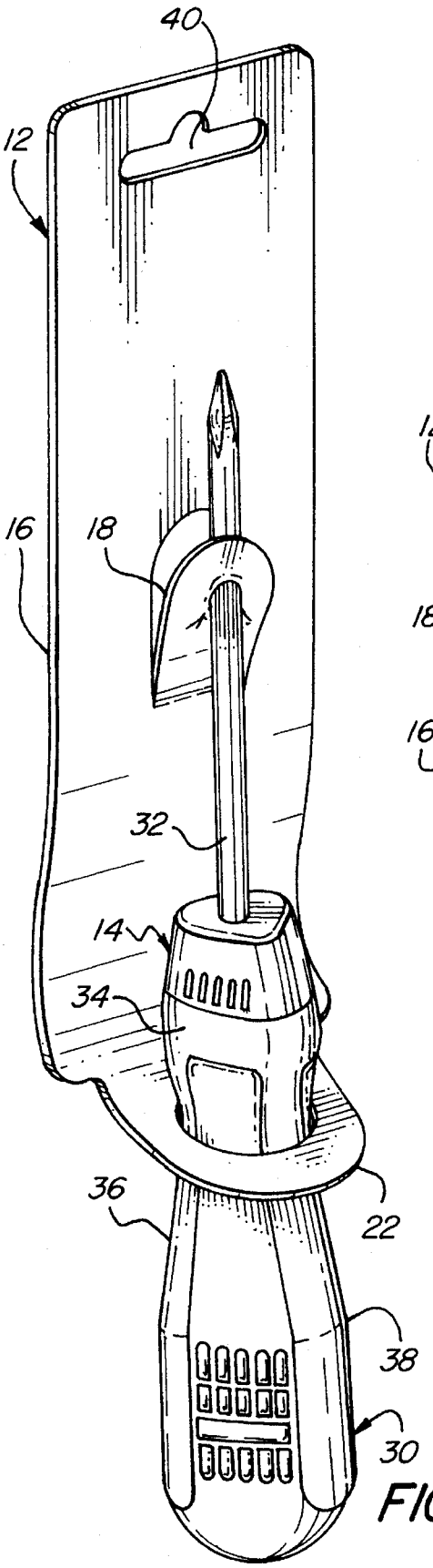
FIG. 1 is a perspective view of a merchandise display package embodying the present invention.

Turning first to FIG. 1, therein illustrated is a merchandise display package embodying the present invention and including a card generally designated by the numeral 12 upon which is mounted a screwdriver generally designated by the numeral 14 and having a shank 32 and a handle generally designated by the numeral 30. As can be seen, the handle 30 has a shoulder 34 adjacent the shank 32 and a portion 36 of reduced cross section from which the cross section increases towards the outer end portion 38.

Figure 2:
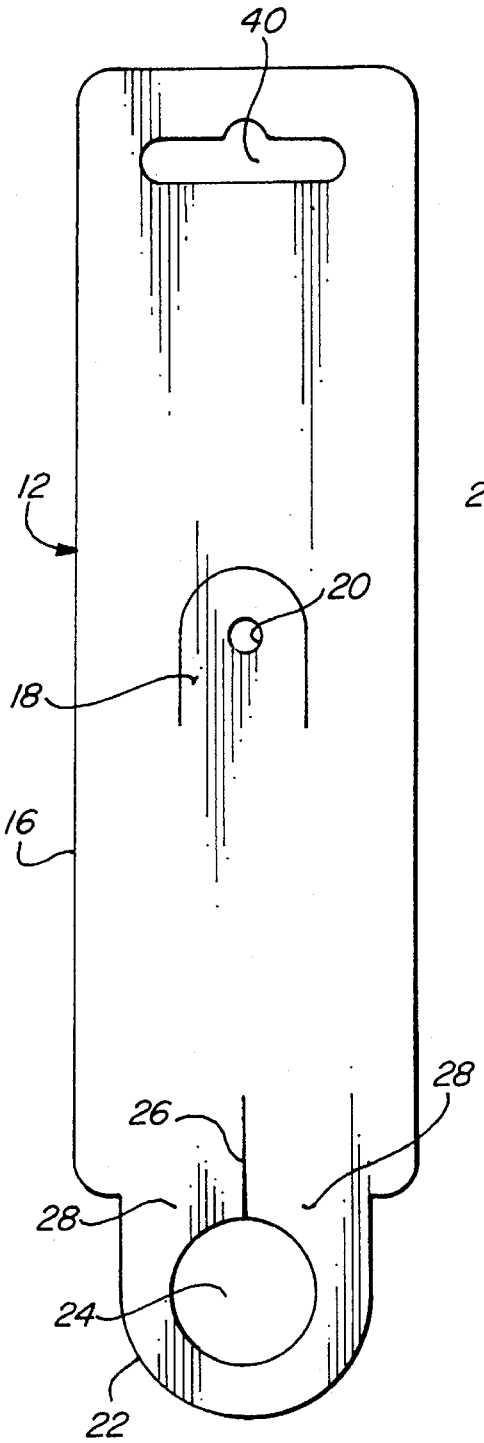
FIG. 2 is a top plan view of the merchandise display card utilized in the package of FIG. 1.
Figure 3:
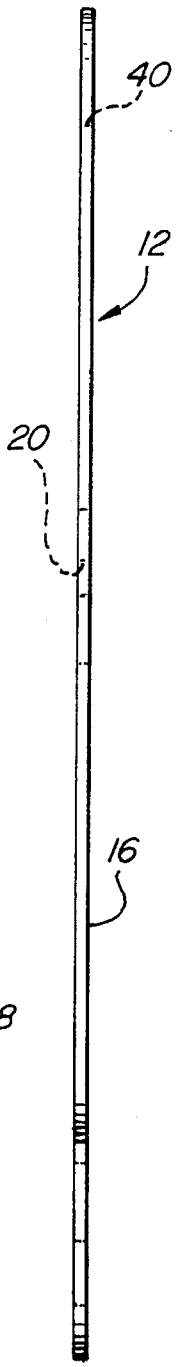
FIG. 3 is a side elevational view of the merchandise display card.

The card 12 is made of a thin, flexible paperboard or like material as best seen in FIGS. 2 and 3. As best seen in FIG. 2, the card 12 has an arcuate shaped tab 18 which is cut through the card 12 and has a circular aperture 20 at its center. The one end portion 22 of the card has a larger circular aperture 24 therein and a restraining slit 26 extends readily from the aperture 24 towards the tab 18.

The portions 28 of the card 12 on either side of the restraining slit 26 are able to flex and thereby facilitate the insertion of the handle 30 and thereafter preclude withdrawal of the handle 30 once inserted thereinto.

The mounting of the screwdriver 14 on the card 12 is illustrated in FIGS. 4 and 5. The flexible end portion 22 of the card 12 is bent at an angle to the planar body portion 16 of the card 12 in the directions indicated by the arrows in FIG. 4 and the tab 18 is also bent upwardly. The shank 32 of the screwdriver is then inserted through aperture 24 and moved along the length of the card 12 towards aperture 20 in the middle of the tab 18.

Since the shoulder 34 of the screwdriver 14 adjacent the shank 32 has a diameter greater than that of aperture 24, the portions 28 adjacent the restraining slit 26 flex to allow passage the shoulder 34 through aperture 24 during insertion of the screwdriver 14. Once the shoulder 34 has passed through the aperture 24, the portions 28 return to their at rest position and the reduced diameter portion 36 of the screwdriver 14 is seated in the aperture 24.

In the mounted state shown in FIGS. 1, 5 and 6, the portions 28 of the card 12 on either side of the restraining slit 26 do not readily deflect and the handle 30 of the screwdriver 14 is restrained from movement in both directions. Moreover, the tab 18 and end portion 22 provide two points of restraint to prevent the end to end rotation of the screwdriver 14 with respect to the card 12. In addition, the diverging orientation of the tab 18 and end portion 22 produces an elastic gripping action on the screwdriver 14 which biases the screwdriver 14 downwardly towards the planar body 16 of the card 12. Thus, the novel design of the present invention requires no additional fasteners to firmly secure the screwdriver 14 to the card 12.

As best seen in FIGS. 1, 2, and 6, the illustrated embodiment includes a mounting aperture 40 at the other end of the card 12 which permits the card 12 to be hung in a vertical position with the handle 30 of the screwdriver 14 pointed downwardly.

As will be appreciated, the card 12 may have alternate configurations from that which is illustrated in the accompanying drawings. For example, the card 12 may be formed with a large tab containing the aperture 24 which extends out of the plane of the card in a manner similar to the tab 18. The card may be provided with a multiplicity of tabs so that several tools can be mounted thereon.

Various materials may be employed for the construction of the card including paperboard and paperboard laminates, and synthetic resins. Desirably, the card should be lightweight and exhibit resiliency over a long duration of time.

Thus, it can be seen from the foregoing detailed description and accompanying drawings that the novel merchandise display package of the present invention is one which effectively secures the tool to the card while allowing an individual to grip the handle and examine the screwdriver. The card may be readily and economically fabricated to mount a large variety of tools such as screwdrivers, awls, chisels, and the like having handles and elongated shanks extending therefrom.

Having thus described the invention, what is claimed is:

1. A display package comprising:

(a) an elongated article having a handle with a shank extending from one end thereof, said handle having a shoulder adjacent said one end, said handle having a portion of reduced cross section between said shoulder and its other end, said handle increasing in cross section from said portion of reduced cross section towards said other end;

(b) a flexible card mounting said elongated article, said card having a generally planar body portion and a flexible portion adjacent one end extending at an angle to said body portion and having an aperture in which is seated said reduced portion of said handle, said flexible portion having a slit extending radially outwardly from said aperture to enable flexure of said flexible portion to permit insertion of said handle into said aperture and to preclude withdrawal of said inserted handle, said card having a flexible tab intermediate the length of said body portion extending at an angle to the plane of said body portion and with an aperture therein aligned with said aperture in said flexible portion, said shank extending through said aperture in said tab.

2. A display package according to claim 1 wherein said flexible portion is the end portion of said card at said one end.

3. A display package according to claim 1 wherein said flexible portion has an arcuate section adjacent said body portion.

4. A display package according to claim 3 wherein said slit extends in said arcuate section towards said body portion.

5. A display package according to claim 1 wherein said tab extends in a direction away from said flexible portion.

6. A display package comprising:

(a) an elongated tool having a handle with a shank extending from one end thereof, said handle having a shoulder adjacent said one end adjacent said shank, said handle having a portion of reduced cross section between said shoulder and its other end, said handle increasing in cross section from said portion of reduced cross section towards said other end, said handle increasing in cross section more rapidly towards said shoulder;

(b) a flexible card mounting said elongated tool, said card having a generally planar body portion and a flexible end portion extending at an angle to said body portion and having an aperture in which is seated said reduced portion of said handle, said flexible end portion having a slit extending radially outwardly from said aperture to enable flexure of said flexible end portion to permit insertion of said handle into said aperture and to preclude withdrawal of said inserted handle, said card having a flexible tab intermediate the length of said body portion extending at an angle to the plane of said body portion with an aperture therein aligned with said aperture in said flexible end portion, and in a direction away from said end portion, said tab having said shank extending through said aperture in said tab.

7. A display package according to claim 6 wherein said flexible end portion has an arcuate section adjacent said body portion.

8. A display package according to claim 7 wherein said slit extends in said arcuate section towards said body portion.

9. A display package according to claim 6 wherein said tool is a screwdriver.

10. In a method for assembling a display package, the steps comprising:

(a) forming a flexible card having (i) a generally planar body portion, (ii) a flexible portion adjacent one end with an aperture therein and a slit extending radially outwardly from said aperture, and (iii) a flexible tab intermediate the length of said body portion with an aperture therein;

(b) bending said flexible portion and tab into positions extending at an angle to the plane of said body portion of said card;

(c) inserting into said aperture of said flexible portion and thence into said aperture of said tab the shank of an elongated article having a handle at one end, said handle having a shoulder adjacent said shank, said handle having a portion of reduced cross section between said shoulder and its other end, said handle increasing in cross section from said portion of reduced cross section towards said other ends; and (d) flexing said flexible portion about said slit to insert said handle into said aperture of said flexible portion and seat said reduced portion of said handle in said aperture of said flexible portion.

11. The method for assembling a display package in accordance with claim 10 wherein said bending step provides an arcuate section adjacent said body portion.

12. The method for assembling a display package in accordance with claim 10 wherein said bending step bends the end portions of said card adjacent said one end.

* * * * *